US005905315A

United States Patent [19]

Lefebvre et al.

[11] Patent Number: 5,905,315

[45] Date of Patent: May 18, 1999

[54] METHOD AND DEVICE FOR CONTROLLING CUT-OFF OF A MOTOR VEHICLE STARTER

[75] Inventors: Bruno Lefebvre, Villeurbanne; René Jacquet, Lyon; Gérard Vilou, Tassin, all of France

[73] Assignee: Valeo Equipements Electriques Moteur, Creteil, France

[21] Appl. No.: 08/820,844

[22] Filed: Mar. 20, 1997

[30] Foreign Application Priority Data

Mar. 21, 1996 [FR] France ..... 96 03511

[51] Int. Cl.[6] ..... F02N 17/00

[52] U.S. Cl. ..... 307/10.6; 123/179.3

[58] Field of Search ..... 307/9.1, 10.1, 307/10.3, 10.6, 10.7, 10.8; 320/127, 134, 136; 340/428, 635, 636; 701/1, 29, 30, 31, 35; 123/179.1, 179.2, 179.3, 179.4

[56] References Cited

U.S. PATENT DOCUMENTS

| | | | |
|---|---|---|---|
| 4,198,945 | 4/1980 | Eyermann et al. | 123/179 B |
| 4,412,137 | 10/1983 | Hansen et al. | 307/10.1 |
| 4,488,521 | 12/1984 | Miller et al. | 123/179.2 |
| 4,490,620 | 12/1984 | Hansen | 290/38 A |
| 4,665,370 | 5/1987 | Holland . | |
| 5,343,137 | 8/1994 | Kitaoka et al. | 320/136 |
| 5,349,931 | 9/1994 | Gottlieb et al. | 123/179.2 |
| 5,479,084 | 12/1995 | Satsuma et al. | 320/136 |
| 5,652,069 | 7/1997 | Sakai et al. | 320/136 |
| 5,743,227 | 4/1998 | Jacquet et al. | 123/179.3 |

FOREIGN PATENT DOCUMENTS

| | | |
|---|---|---|
| 2626417 | 7/1989 | France . |
| WO 90/04188 | 4/1990 | WIPO . |

*Primary Examiner*—Richard T. Elms
*Attorney, Agent, or Firm*—McCormick, Paulding & Huber

[57] ABSTRACT

A motor vehicle starter is controlled by a control device which cuts off the starter by measuring the power supply voltage of the starter and interrupting the power supply when that voltage reaches a threshold value. The threshold value is a function of the value of the power supply voltage measured at the inception of the starting operation.

7 Claims, 2 Drawing Sheets

METHOD AND DEVICE FOR CONTROLLING CUT-OFF OF A MOTOR VEHICLE STARTER

FIELD OF THE INVENTION

The present invention relates to a method and apparatus for controlling cut-off (and therefore for stopping the operation) of a motor vehicle starter once the heat engine of the vehicle has been started.

BACKGROUND OF THE INVENTION

Driving of a heat engine by its starter is usually controlled by the user of the vehicle, who releases the ignition key once the engine makes a characteristic sound. However, there is a current tendency to make motor engines more and more silent, and this tendency makes it increasingly difficult for the driver to detect the end of the starting operation. This in turn leads to the application of severe, and quite unnecessary, forces on the starter. A number of devices are already known for cutting off a motor vehicle starter when the engine has started satisfactorily, that is to say when the engine is sufficiently autonomous to attain its slow running mode by itself.

In particular, it has been proposed to control the cut-off of the starter by comparing the battery voltage with a reference voltage, the starter being cut off when the battery voltage reaches this reference voltage. One device which makes use of such a method of control was described in the introduction of French patent specification No. 2 626 417. In this connection, it is known that when a starter begins the starting operation, during which the starter is driving the engine, the voltage across the terminals of the battery undergoes a sharp diminution, due to the high current flowing through the starter. The battery voltage regains its initial level once the engine has been started.

However, such an arrangement is not satisfactory. In particular, the battery voltage can vary considerably over a period of time, in particular as a function of its state of maintenance, or as a function of ambient temperature. As a result, if the battery voltage is too low, it can happen that the starter will not be cut off immediately after the engine has been properly started, and in consequence the starter may be in operation for far too long, quite unnecessarily.

By contrast, if the battery voltage is too high, it can happen that the starter will be cut off too soon, i.e. well before the engine has properly started.

DISCUSSION OF THE INVENTION

One object of the invention is to overcome the above mentioned drawbacks.

According to the invention in a first aspect, a method of controlling the cut-off of a motor vehicle starter, in which the power supply voltage to the starter is measured and the starter is cut off when this voltage reaches a threshold value, is characterised in that the said threshold value is a function of the value of the power supply voltage at the inception of the starting operation.

According to the invention in a second aspect, a device for controlling the cut-off of a motor vehicle starter, comprising means for measuring the power supply voltage to the starter, together with means for comparing the value thus measured with a threshold value of the said voltage, is characterised in that the device includes means for memorising the value of the said voltage measured at the inception of the starting operation, the said threshold value being a function of the value of the power supply voltage at the inception of the starting operation.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
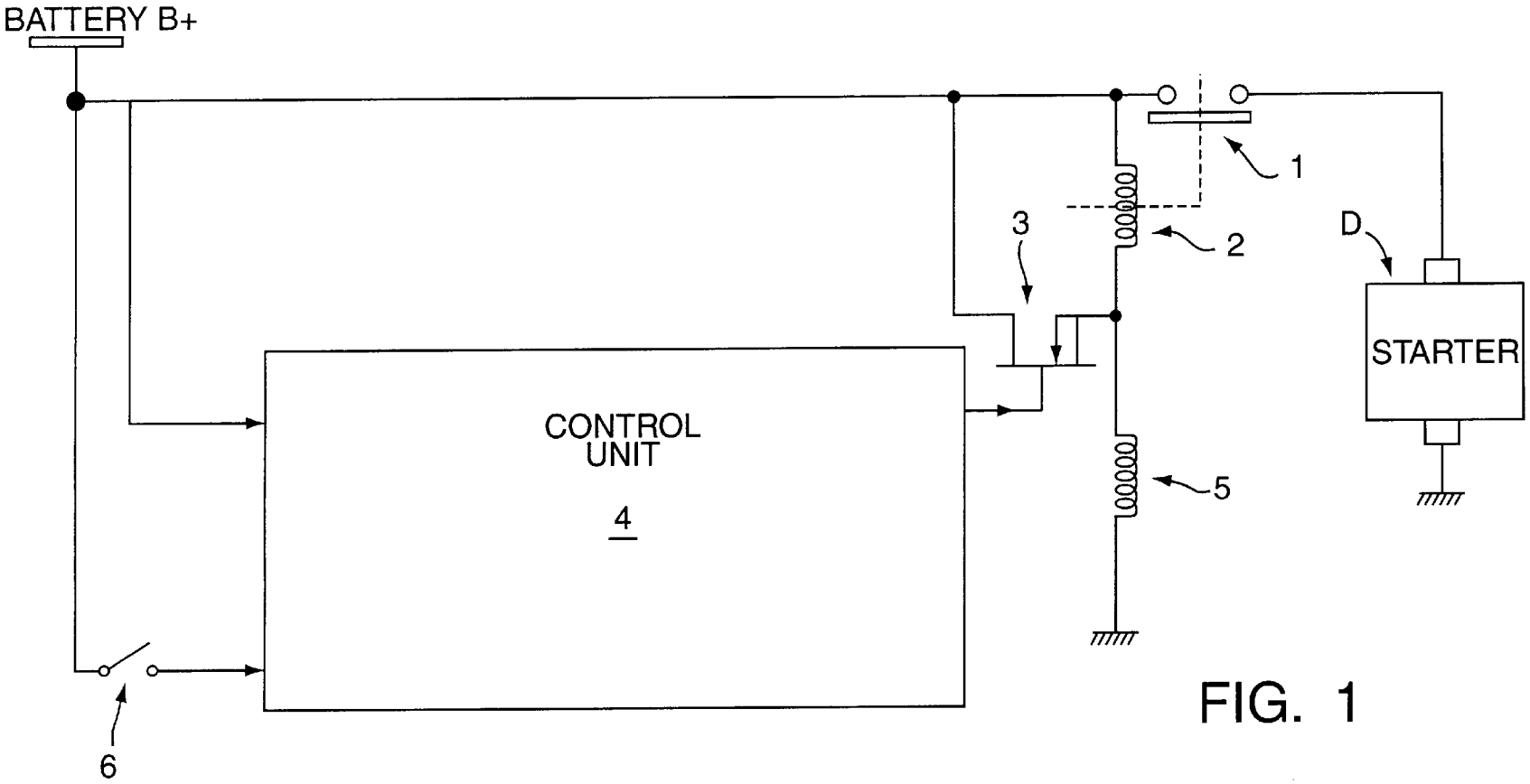
FIG. 1 is a diagram of a cut-off control device for a starter in accordance with one possible embodiment of the invention.

FIG. 1 shows a device for controlling the power supply to a starter D. Such a starter conventionally consists of an electric motor which is connected between a power supply terminal $B^+$ at the battery voltage of the vehicle, and another terminal connected to ground (earth). The cut-off control device includes a first contactor 1 which is connected between the power supply terminal $B^+$ at the battery voltage and the starter D.

The contactor 1 is a relay which is actuated by a relay coil 2. One end of the relay coil 2 is connected to the power supply terminal $B^+$. Its other end is connected partly to the source of a MOSFET transistor 3 and partly to another coil 5, which is connected to ground. The drain of the transistor 3 is connected to the power supply terminal $B^+$, while its grid is connected to the output of a control unit 4, from which it receives a control voltage. It will of course be understood that the transistor 3 may be replaced by any other suitable type of interrupter.

In the particular example illustrated in the drawings, the unit 4 generates the control voltage as a function, firstly, of the voltage at the power supply terminal $B^+$, and secondly of the position of a second contactor, which is the one operated by the ignition key, this contactor being indicated in FIG. 1 at 6.

Figure 2:
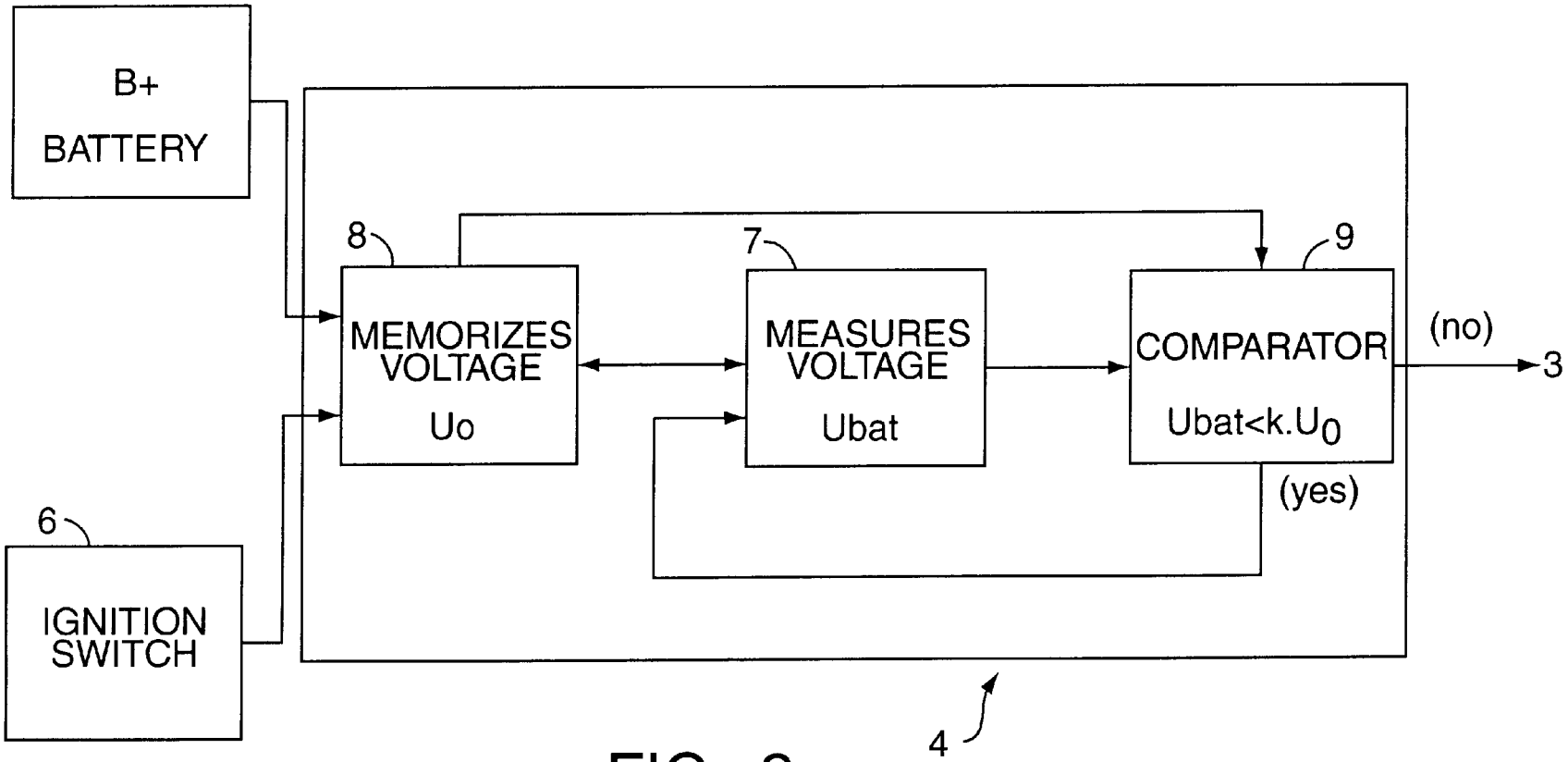
FIG. 2 is a block diagram which shows a possible embodiment of the control means in the device of FIG. 1.

The control unit 4 consists in this example of the arrangement shown diagrammatically in FIG. 2, in which the unit 4 includes means 7 for measuring the voltage at the power supply terminal $B^+$ for the starter D (this voltage being denoted $U_{bat}$). The control unit 4 also includes means 8 for memorising the voltage $U_O$ at the terminal $B^+$ at the inception of the starting operation, that is to say when the ignition key closes the contactor 6.

It is preferred, in particular, that this initial measurement shall take place soon enough for the voltage $U_O$ to correspond to the battery voltage before there is any reduction in the battery voltage.

The voltage at the power supply terminal $B^+$ is then measured continuously during the whole of the starting operation. The voltage $U_{bat}$, thus measured, is compared by a comparator 9 to a threshold value $U_f$, which is the final voltage at the end of the starting operation and which is a function of the initial value $U_O$ of the voltage. In a preferred method of operation, the voltage $U_f$ is such that $U_f = k.U_O$, in which k is $\leqq 1$. The value of k is for example chosen as a function of the mean battery voltage at the end of the starting operation, for a given running level of the engine started by the starter D.

So long as the voltage $U_{bat}$ is less than this threshold value $U_f$, blocking of the transistor 3 is inhibited. The transistor 3 being closed, the coil 2 is short circuited, and the contactor 1 is itself closed. However, when the voltage $U_{bat}$ becomes greater than $U_p$, blocking of the transistor 3 is no longer inhibited. The coil 2 is therefore no longer short circuited, and the contactor 1 is now open. The power supply to the starter D is therefore cut off.

It will of course be understood that the various circuits constituting the control unit 4 may be of either an analogue or a digital type.

As will have been understood from the foregoing, the arrangement proposed by the invention enables the duration of the starting operation to be systematically reduced to the minimum necessary amount. In particular, this arrangement enables variations in the battery voltage to be reduced, and in particular those which are due to variations in temperature. The comfort of the occupants of the vehicle is thereby improved. The invention makes it possible to consider lightening or simplifying the starter head, by omitting the free wheel function.

In addition, the proposed solution has the advantage of being entirely autonomous, and it calls for no additional wiring during installation in the vehicle.

The assembly comprising a control device of the type proposed by the invention, together with its alternator, is in practice interchangeable with a conventional starter system.

It will also be noted that the current through the ignition contactor 6 is at a very low level, for example a few milliampères instead of the typical values of 10 to 40 ampères currently found in practice. As a result of this, the starter proposed by the invention may be treated as a low-current control device, which opens the way to numerous developments in the control of the starting operation. Examples include control by input of coded signals, control by the accelerator pedal, and so on.

What is claimed is:

1. A method of controlling cut-off of a motor vehicle starter during a starting operation of the vehicle, comprising the steps of providing a power supply having an output voltage to the starter variable with external conditions, measuring the output voltage of the power supply to the starter and interrupting power to stop the starter when the output voltage reaches a threshold value, the threshold value being a function of the value of said variable output voltage prior to the starting operation.

2. A method according to claim 1, the vehicle having a battery supplying power to the starter, wherein the output voltage of the battery at the inception of the starting operation is the value of the output voltage of the battery prior to the occurrence of any reduction in the battery output voltage.

3. A method according to claim 2, wherein the threshold value is a value of the said output voltage which corresponds to $k.U_O$, where $k \leqq 1$ and $U_O$ is the value of the said voltage at the inception of the starting operation.

4. A device for controlling cut-off of a motor vehicle starter, comprising a power supply for the starter variable with external conditions, a means for measuring the output voltage of the power supply to the starter, and a comparator connected to said measuring means for comparing the measured voltage with a predetermined threshold voltage, a means for memorizing the measured power supply voltage prior to the starting operation, the said threshold value being a function of said variable power supply voltage prior to the starting operation and a means for interrupting the power supply to the starter when the output voltage reaches the threshold voltage.

5. A device according to claim 4, wherein the voltage of the power supply at the inception of the starting operation is the output voltage of the power supply prior to the occurrence of any reduction in said battery voltage.

6. A device according to claim 5, wherein the threshold voltage which corresponds to $k.U_O$, where $k \leqq 1$ and $U_O$ is the voltage at the inception of the starting operation.

7. A device according to claim 4, including: a first contactor for controlling power supply to the starter; a second contractor operable by a driver of the vehicle for actuating the same, the starter having a power supply terminal; and a control unit for controlling said first contactor, the control unit being connected first to a said power supply terminal of the starter, and secondly to said second contactor, said control unit comprising the measuring means, comparator and memorizing means.

* * * * *